US005707207A

United States Patent [19]

Benoist et al.

[11] Patent Number: 5,707,207

[45] Date of Patent: Jan. 13, 1998

[54] LAYOUT FOR CONNECTING TWO ANGULAR SECTORS OF A TURBOMACHINE, AND SEAL DESIGNED FOR USE IN THIS LAYOUT

[75] Inventors: Josette Benoist, Le Mee sur Seine; Paul Martyez, Montgeron, both of France

[73] Assignee: Societe Nationale d'Etude et de Construction de Moteurs d'Aviation "Snecma", Paris, France

[21] Appl. No.: 618,720

[22] Filed: Mar. 20, 1996

[30] Foreign Application Priority Data

Mar. 29, 1995 [FR] France ..... 95 03666

[51] Int. Cl.[6] ..... F01D 11/12

[52] U.S. Cl. ..... 415/173.4; 415/170.1; 415/173.5; 415/173.7; 415/174.4; 415/174.5; 277/53; 277/167.5; 277/206 R

[58] Field of Search ..... 415/138, 139, 415/173.4, 173.5, 173.7, 174.4, 174.5, 170.1, 173.1; 277/53, 167.5, 206 R

[56] References Cited

U.S. PATENT DOCUMENTS

| | | | |
|---|---|---|---|
| 3,092,393 | 6/1963 | Morley et al. | 415/174.4 |
| 3,126,149 | 3/1964 | Bowers, Jr. et al. | 415/173.4 |
| 3,701,536 | 10/1972 | Matthews et al. | 415/174.4 |
| 4,537,024 | 8/1985 | Grosjean | 415/139 |
| 5,388,959 | 2/1995 | Forrester et al. | 415/173.4 |

FOREIGN PATENT DOCUMENTS

| | | |
|---|---|---|
| 0 147 354 | 7/1985 | European Pat. Off. . |
| 0 531 133 | 3/1993 | European Pat. Off. . |
| 0 545 589 | 6/1993 | European Pat. Off. . |
| 0 578 460 | 1/1994 | European Pat. Off. . |
| 2 055 983 | 3/1981 | United Kingdom . |
| 2 116 641 | 9/1983 | United Kingdom . |
| 2 127 104 | 4/1984 | United Kingdom . |
| 2 224 082 | 4/1990 | United Kingdom . |

*Primary Examiner*—Christopher Verdier
*Attorney, Agent, or Firm*—Oblon, Spivak, McClelland, Maier & Neustadt, P.C.

[57] ABSTRACT

A layout for connecting two platforms of a turbomachine which support blades. A common clearance between the blades is occupied by a seal which includes a core placed in channels under the surface of the platforms and strips which close off the clearance and which are embedded in a layer of easily eroded material. Not only do the core and the strips close off the clearances, but the seal can be designed with a sufficient stiffness to oppose any excessive movement of the platforms. The strips can also be used alone without the seal.

6 Claims, 3 Drawing Sheets

LAYOUT FOR CONNECTING TWO ANGULAR SECTORS OF A TURBOMACHINE, AND SEAL DESIGNED FOR USE IN THIS LAYOUT

DESCRIPTION

The invention relates to a layout for connecting two adjacent platforms of a turbomachine, as well as to a seal designed for use in said layout.

Turbomachine designs are often found in which certain elements such as the nozzles of the stator are made up of an assembly of parts which are themselves made up of a platform in the form of cylinder or cone sectors fitted with blades. The platforms are placed adjacent to each other to form a surface as continuous as possible, and they are sometimes provided, on their surface opposite the one from which the blades rise, with a layer of easily eroded material, often said to be "abradable" in this technique and whose role is to provide sealing under the platforms while undergoing local wear against facing rigid parts called wipers and which belong to the rotor. The wear of the layer makes it take the form of these parts while tolerating only a small clearance allowing the passage of almost no leakage.

As it is impossible to perfectly join the platforms, small clearances are left between their facing edge sides and allow gas leaks through said clearances. The prior art has already thought of combating these leaks by providing grooves in the faces opposite the platforms to receive a tongue seal which extends along the clearance and thus blocks the leakage paths in the radial direction towards the rotor. However, it was observed that the leaks in the axial direction of the machine, along the clearance, were also not to be neglected, especially as the abradable layer is also divided into sectors fixed to the respective platforms and which are also not contiguous, with the consequence that the section of the clearance in the axial direction is greatly increased.

The layout of the invention for connecting two adjacent platforms covered with a layer of easily eroded material on radially oriented faces is characterized by cavities extending radially over the platforms and through the layer, and opening onto the clearance, and by strips occupying the cavities and closing off the clearance. The strips thus serve to provide the required leak-tightness in the axial direction. The cavities advantageously are in the form of grooves which retain the strips suitably.

According to an important embodiment of the invention, on the platforms the cavities form channels open onto the clearance and onto the layer and having stop faces before edges of the platforms coinciding with ends of the clearance, and a seal is added which is provided with a core occupying the channels, the strips being joined to the core. One thus has a single seal thanks to which the assembly is easy.

Moreover, the seal may be designed easily so that it opposes the movement of the platforms thanks to its rigidity. A case in which this property is verified is that of a core having a U-section placed against the channels and covering the clearance, and curved ends parallel to the strips and placed against the channel stop faces.

Another object of the invention is the seal previously described and designed especially for this application.

The invention will now be described in greater detail through a particular embodiment in connection with the appended drawings in which.

Figure 1:
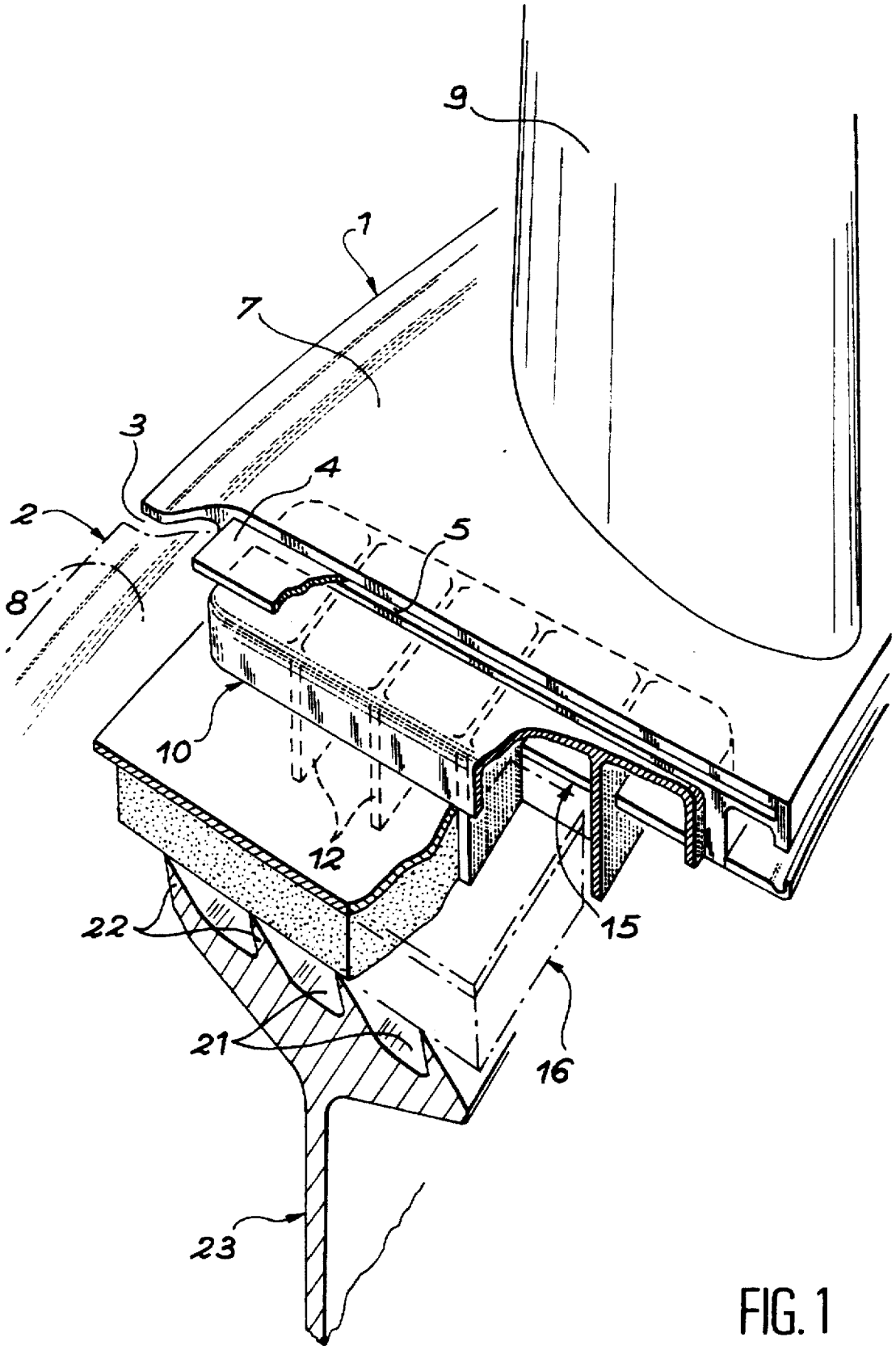
FIG. 1 is an overall view of the layout, partially in cross section.
Figure 2:
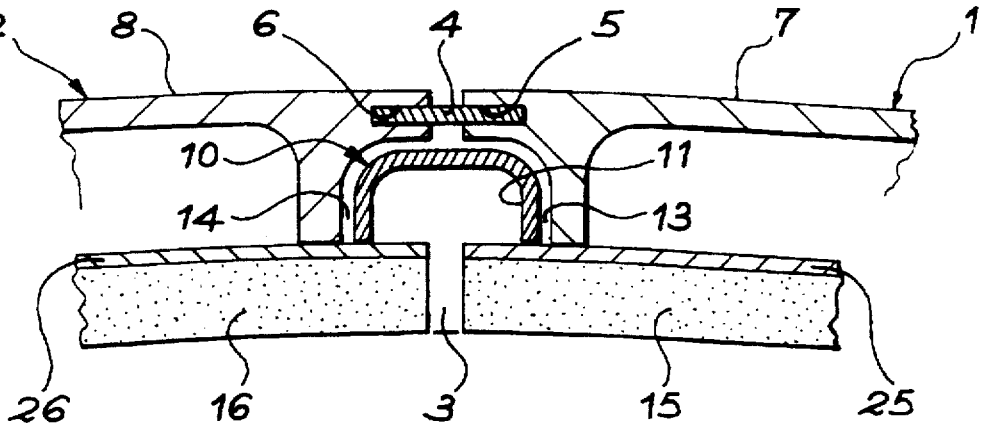
FIGS. 2 and 3 are two perpendicular sections of this embodiment.
Figure 3:
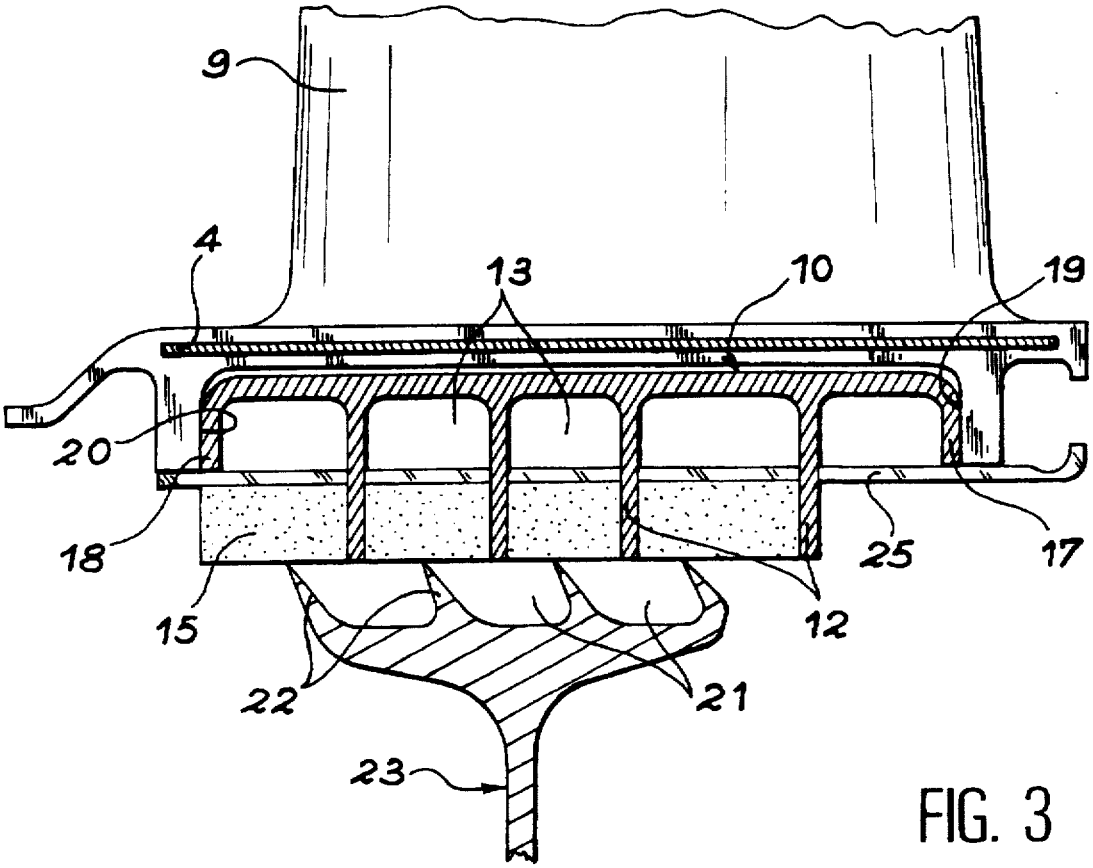

Represented are two platforms 1 and 2 in the form of a cylinder or cone sector which abut so as to have a common clearance 3, with an axial orientation in the machine. This clearance can be covered by a tab 4 whose principal faces are directed radially and whose side edges are sunk into facing grooves 5 and 6 provided in the edge sides of the platforms 1 and 2, and which are almost flush here with the surfaces 7 and 8 of the platforms carrying the blades 9. This is an already known construction whose purpose is to prevent gas leaks in the radial direction; the basic element of the invention is however a seal 10 composed of a core 11 with a U-section and strips 12 in a single piece with the core 11 and whose faces have an axial orientation.

The core 11 is engaged in axial channels 13 and 14 established on each of the platforms 1 and 2, and which open towards each other and towards the surfaces of the platforms 1 and 2 which are opposite the surfaces 7 and 8 and which cover part of the layer of easily eroded material, respectively 15 or 16 and which can consist of a honeycomb layer. Each of the layer parts 15 and 16 extends over the respective channel 13 or 14 so as to cover it and so that only the clearance 3 remains between them. This situation is such that the strips 12, which already divide the volume of the channels 13 and 14 into sections, must be more extensive and intimately mixed with the layer parts 15 and 16 to also close off this part of the clearance 3. An inset may be obtained in practice by providing notches in the layer parts 15 and 16 at the location of the strips 12 and by placing the strips 12 in these notches when the layer parts are placed and fixed to the platforms 1 and 2 proper.

It is seen that the strips 12 close off almost completely the clearance 3 and the channels 13 and 14 and considerably reduce gas leaks in the axial direction. The core 11 is advantageously placed against the surfaces of the channels 13 and 14 with little or no clearance. It can be terminated by curved edges 17 and 18 at the front and at the back, substantially parallel to the strips 12 and which fit, with no or practically no clearance, against stopping faces 19 and 20 of the channels 13 and 14 in the axial direction, which are near edges of the platforms 1 and 2. If the platforms 1 and 2 move mutually in the axial direction, they shear the core 11 which however has the ability to withstand and counter these undesired movements which could separate the platforms 1 and 2. The curved edges of the core 11, at the ends as well as on the sides, are also designed to hold the plate 25 supporting the parts 15 and 16 of the easily eroded layer and to prevent it from descending into the channels 13 and 14.

It is noted that it is suitable for the strips 12 to extend in front of furrows 21 separating peaks or wipers 22 of the rotor rubbing on the layer parts 15 and 16 and which shape them to complete the leak-tightness between a disk 23 of the rotor carrying these wipers 22 and the platforms 1 and 2; the strips 12 can project beyond the layer parts 15 and 16 to extend into the furrows 21.

It would be possible to consider the elimination of the tab 4 if, for example, the core 11 were perfectly against the bottom of the channels 13 and 14 or against their side wall. It would also be possible to replace the tab 4 by another seal. The seal 10 of the invention can thus be used perfectly independently.

Another embodiment is described with reference to FIG. 4. The seal 10 is omitted and the sealing device includes only the strips, here designated by the reference 28 and which occupy grooves 29 made in the platforms 1 and 2. These grooves 29 open onto the edge face towards the other platform, and extend in a generally radial direction through the thickness of the platforms and of the abradable layer parts 15 and 16, and up to the face of this layer opposite the platforms 1 and 2, on the one hand, and up to the axial groove 5 of the tab 4, on the other. The strips 28 could thus slip from the grooves 29, and fall on the disk 23 if they did not have a variable curvature, and designed here more precisely with an undulation 30 or an oblique part, separating two straight portions 31 and 32. The strips 28 are rounded with the same form and thus kept in their place.

Figure 4:
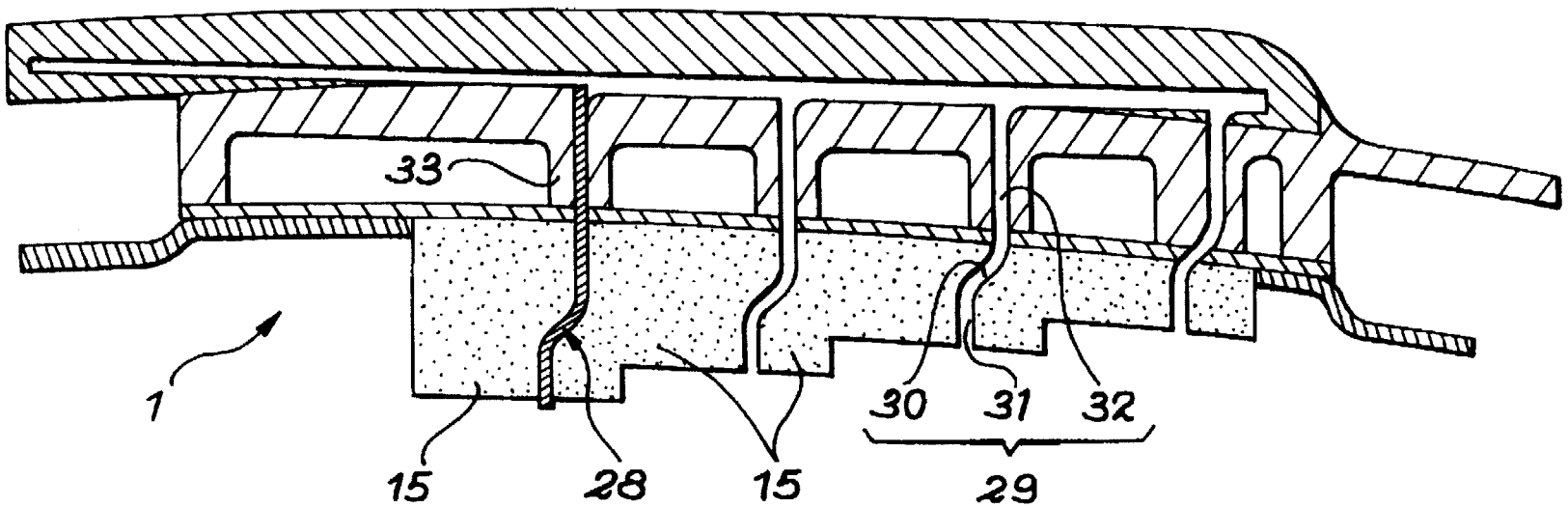
FIG. 4 illustrates another embodiment.

Only one of the platforms (here 1) is represented in FIG. 4, but it is understood that the other is designed in the same manner and in particular that the strips 28 also extend in similar grooves of the other platform so as to totally close off the clearance 3. The channels 13 and 14 are advantageously omitted here, and the platforms 1 and 2 are designed with ribs 33 backing the grooves 29, which extend up to the abradable layer.

In this embodiment, as in the preceding one, the platforms 1 and 2 are held by the blades 9, themselves connected through their opposite end (not visible in the figures) to external platforms fixed to a stator ring and which can also be made up of juxtaposed sectors. Sealing devices similar to tabs and strips may be used to close off the clearances between these other sectors.

I claim:

1. A layout for connecting two adjacent platforms extending in at least an axial direction, the platforms carrying respective layers of abradable material on radially oriented faces of the platforms and the platforms and the layers being separated by a clearance, wherein grooves extend in the platforms and through the layers of abradable material, the grooves opening onto a clearance of curvature, having a shape comprising variations wherein sealing strips are inserted in said grooves, said strips extending between both the platforms and layers of abradable material and closing off the clearance.

2. The layout of claim 1, wherein the grooves lead out, in the platforms, onto a channel in both the platforms which straddles the clearance and extend, in the axial direction.

3. A layout for connecting two adjacent platforms extending in at least an axial direction, the platforms carrying respective layers of abradable material on radially oriented faces of the platforms and the platforms and the layers being separated by a clearance, wherein grooves extend in the platforms and through the layers of abradable material, the grooves opening onto a clearance of curvature, wherein sealing strips are inserted in said grooves, said strips extending between both the platforms and layers of abradable material and closing off the clearance, wherein the channel ends at stop faces of the platforms in the axial direction and is occupied by a sealing core to which said strips are connected.

4. The layout of claim 3, wherein the sealing core has a U-section comprising linear edges which bear on the layers of abradable material, and covers the clearance in the radial direction.

5. The layout of claim 3, wherein the sealing core comprises end walls which contact the stop faces.

6. A seal between adjacent platforms of a turbomachine, the platforms carrying respective abradable layers and the platforms and the layers being separated by a clearance, wherein the seal comprises a core occupying a channel in the platforms, the channel straddling the clearance and extending in an axial direction of the turbomachine, and strips connected to the core and occupying grooves in the platforms and abradable layers, the strips extending substantially in a radial direction of the turbomachine and straddling the clearance, the clearance being closed off by the strips in the axial direction and by the core in the radial direction.

* * * * *